US005957815A

United States Patent [19]

Labrenz

[11] Patent Number: 5,957,815

[45] Date of Patent: Sep. 28, 1999

[54] DRY-TRAINING APPARATUS FOR SIMULATING CRAWL SWIMMING MOVEMENTS

[76] Inventor: Hermann Labrenz, Schönhauser Allee 186, D-10119 Berlin, Germany

[21] Appl. No.: 08/755,454

[22] Filed: Nov. 22, 1996

Related U.S. Application Data

[63] Continuation of application No. PCT/DE95/00650, May 12, 1995.

[51] Int. Cl.[6] ..... A63B 69/10

[52] U.S. Cl. ..... 482/56; 434/254

[58] Field of Search ..... 434/254; 482/56, 482/55, 51, 37, 54, 142

[56] References Cited

U.S. PATENT DOCUMENTS

| | | | |
|---|---|---|---|
| 2,109,775 | 3/1938 | Hudson . | |
| 5,366,426 | 11/1994 | Glavin | 482/56 |
| 5,391,129 | 2/1995 | Zaitsev | 482/56 |
| 5,429,564 | 7/1995 | Doane | 482/56 |

FOREIGN PATENT DOCUMENTS

| | | | |
|---|---|---|---|
| 0597376 | 2/1978 | U.S.S.R. | 482/56 |
| 597 376 | 2/1978 | U.S.S.R. . | |
| 93/24190 | 12/1993 | WIPO . | |

*Primary Examiner*—Stephen R. Crow

*Attorney, Agent, or Firm*—Herbert L. Lerner; Laurence A. Greenberg

[57] ABSTRACT

A dry-training apparatus for simulating crawl swimming movements includes deflection rollers and a braking device for the deflection rollers. An endless traction member guided over the deflection rollers has an endless belt of hard elastic material with a surface, a lower strand, and an upper strand that can sag elastically toward the lower strand. A supporting element is disposed above the traction member. At least three handles are firmly joined to the surface of the revolving belt for moving the traction member in alternation by two hands of a user located on the supporting element. The handles are disposed at a mutual spacing causing a resting and synchronizing phase to necessarily ensue between two exertions of force on successive handles, in which phase the traction member moves onward solely by its moment of inertia.

16 Claims, 1 Drawing Sheet

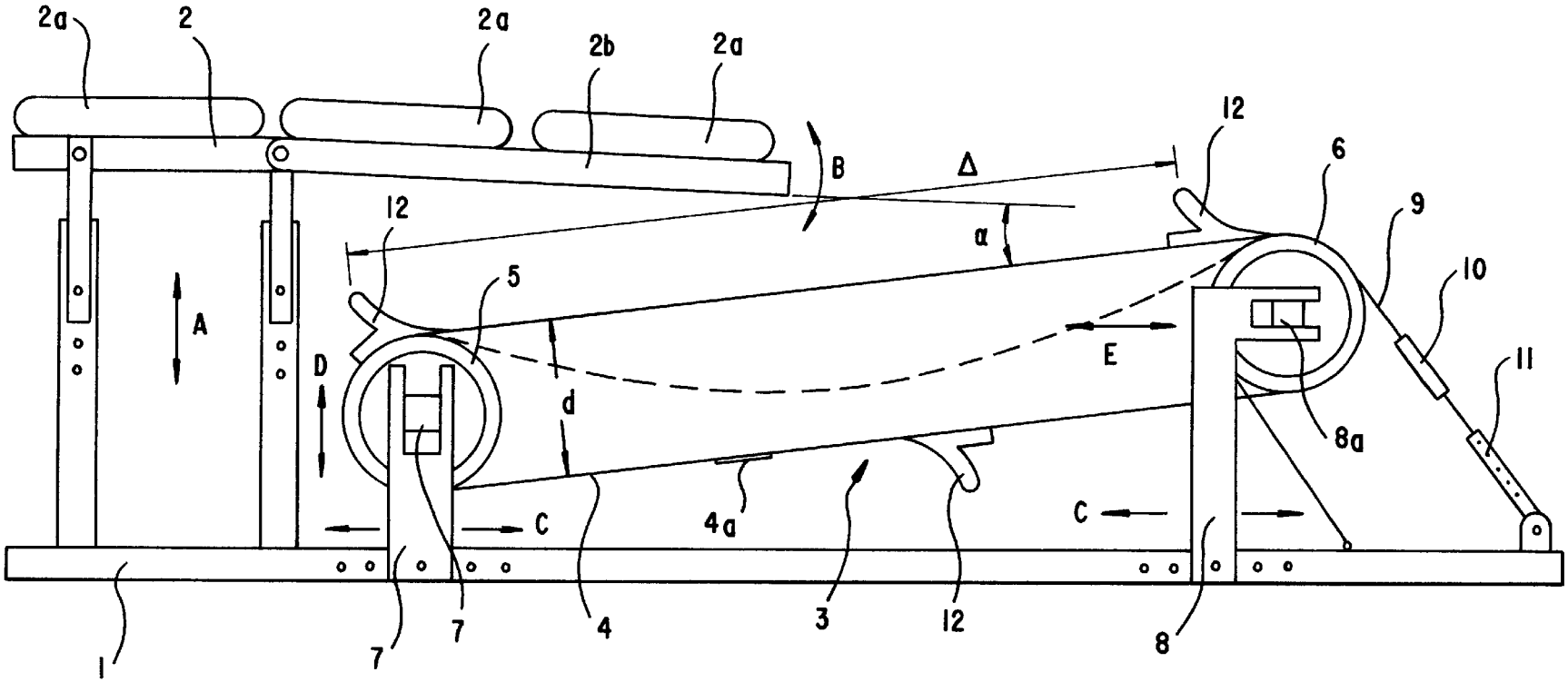
11
10
9
6
8a
12
8
E
C
Δ
α
12
3
B
4a
2a
2b
4
d
C
2a
5
7
12
7
D
2
A
1
2a

DRY-TRAINING APPARATUS FOR SIMULATING CRAWL SWIMMING MOVEMENTS

CROSS-REFERENCE TO RELATED APPLICATION

This application is a Continuation of International Application Serial No. PCT/DE95/00650, filed May 12, 1995.

BACKGROUND OF THE INVENTION

1. Field of the Invention

The invention relates to a dry-training apparatus for simulating crawl swimming movements, with an endless traction member guided over deflection rollers that have a braking device, and a plurality of handles mounted on the traction member and spaced apart from one another for moving the traction member in alternation by two hands of a user located on a supporting element disposed above the traction member.

In a device for muscle training for swimmers and particularly for simulating a crawl motion, which is already known from German Published, Non-Prosecuted Patent Application DE 42 18 478 A1, two traction members, each in the form of a quarter circle and guided around two turning points, taper toward one another at an acute angle in front of the user resting on a support surface. The traction members are provided with a loading device in order to present a resistance force to the motion of the user's arms. They each include two side by side chains or belts, joined by many successive handles, which are supported on the upper and lower sides or strands on adjustable quarter-circle support rollers.

Although it is possible, with that dry training apparatus for crawl swimming, to strengthen muscle parts which are especially stressed in that type of swimming, nevertheless the resistance forces when the swimmer moves in water, which moreover depend on the swimming speed, cannot be simulated with that apparatus. Due to the alternating actuation of one traction member or the other, the traction member must repeatedly be put into motion from virtually the state of repose, as if the swimmer, each time he or she pulls with his or her arm, were just beginning to swim. As a result, overloads on the muscles and joints cannot be precluded. In that sense, the apparatus is also unsuitable for exact simulation of crawling or for teaching and training crawling, since it is left to the user when he or she will begin his or her next arm pull, and where on the traction member, which has many handles on it, he or she will begin. Moreover, the motion that can be executed with that training device, where the arm is always extended, does not match the actual posture of the arms in crawl swimming.

With the crawl swimming training apparatus described in Soviet Inventor's Certificate 597 376 as well, which is formed like a conveyor belt of an endless traction member with a rectilinear upper side or strand, the actual path of motion of the arms in crawl swimming, in which as is well-known each hand during its exertion of force is guided in the water in a long half-oval below the body, cannot be simulated. Moreover, with that apparatus as well, coordinating the sequence of motion of both arms or the frequency of arm motions is left to the judgment of the athlete, who drives the belt at an arbitrary point and at arbitrary time intervals.

SUMMARY OF THE INVENTION

It is accordingly an object of the invention to provide a dry-training apparatus for simulating crawl swimming movements, which overcomes the hereinafore-mentioned disadvantages of the heretofore-known devices of this general type in such a way that a sequence of motion which is close to actual conditions while swimming the crawl in water, and an exertion of force on the human body that extensively matches crawl swimming, are attained.

With the foregoing and other objects in view there is provided, in accordance with the invention, a dry-training apparatus for simulating crawl swimming movements, comprising deflection rollers; a braking device for the deflection rollers; an endless traction member guided over the deflection rollers, the traction member having an endless belt of hard elastic material with a surface, a lower strand, and an upper strand that can sag elastically toward the lower strand; a supporting element disposed above the traction member; and at least three handles firmly joined to the surface of the revolving belt for moving the traction member in alternation by two hands of a user located on the supporting element, the handles disposed at a mutual spacing causing a resting and synchronizing phase to necessarily ensue between two exertions of force on successive handles, in which phase the traction member moves onward solely by its moment of inertia.

Since the traction member is constructed as an elastic belt that is unsupported on its upper side or strand and can sag downward, the force and motion conditions in the water are simulated as realistically as possible, because the palm of the applicable hand must overcome the pressure in both the swimming direction and at right angles to it, and during its exertion of force is guided in a curve, corresponding approximately to half of an elongated oval, that extends relatively tightly below the body.

The essence of the invention is also expressed by the disposition of the handles at a spacing that uniformly dictates to the user the rhythm of his or her arm motions.

The exertion of force on the belt is effected, as a consequence of the chosen spacing of the handles, not in an immediate or freely selectable succession but instead between two exertions of force on the belt or on successive handles, so that a certain resting phase or synchronizing phase remains, within which the guiding hand remains in the position of repose and waits for the next handle. Within this period of time, the traction member is then not driven but instead, with a slight drop in speed, it moves onward solely by the force of inertia, which is above the forces of friction and braking.

Due to crawl swimming being realistically simulated, the proposed apparatus can be used both in general physical training and in physiotherapy, and it produces a proportional buildup of muscle as a result of the dynamic exertions of force. On the other hand, it is appropriate in specialized athletic activities, such as leisure sports, where badminton and volleyball players can practice with it. Finally, a specific field where it can be used is specialized dry crawl swimming training, since on one hand, conditions in the water are simulated virtually precisely, and on the other hand, a sequence of motion, that is a motion of the arms and upper body and a rhythm of motion, are dictated to the athlete so as to make him or her capable, up to his or her own maximum level of physical accomplishment, of learning and practicing the specialized sequence of the crawling motion.

In accordance with another feature of the invention, the traction member has a tip, and the supporting element and the traction member have longitudinal axes forming an acute angle $\alpha \leqq 30°$ originating at the tip.

In accordance with a further feature of the invention, there is provided a frame on which the supporting element is angularly adjustable in longitudinal direction and is adjustable in height.

In accordance with an added feature of the invention, there is provided a strut, and a vertical guide on the strut, the first deflection roller associated with the vertical guide for adjusting the traction member in height.

In accordance with an additional feature of the invention, there is provided a strut, and a horizontal guide on the strut, the deflection roller associated with the horizontal guide for tightening the endless belt.

In accordance with yet another feature of the invention, the struts are adjustable in horizontal direction on the frame.

In accordance with yet a further feature of the invention, the at least three handles are more than three handles, and the revolving belt is longer or has a device for lengthening the revolving belt.

In accordance with yet an added feature of the invention, the revolving belt is adjustable in length, and the handles are disposed adjustably on the revolving belt.

In accordance with yet an additional feature of the invention, the braking device includes a braking belt wrapped around one of the deflection rollers, and an adjustable tensioning device securing the braking belt to the frame.

In accordance with again another feature of the invention, the braking device has a braking force to be adapted as a function of a measured actual speed of the revolving belt.

In accordance with again a further feature of the invention, the braking device has a resistance force with a magnitude to be adjusted up to 196.2 N to be overcome by a user.

In accordance with again an added feature of the invention, the moment of inertia of the traction member causes a drop in speed in the undriven synchronizing phase of the traction member to be $\leqq 10\%$.

In accordance with again an additional feature of the invention, the deflection rollers each have a diameter $\geqq 15$ cm.

In accordance with a concomitant feature of the invention, the deflection rollers have a diameter adjusted or varied in proportion to the spacing between the handles in a range from 1:7 to 1:9, preferably 1:8.

Other features which are considered as characteristic for the invention are set forth in the appended claims.

Although the invention is illustrated and described herein as embodied in a dry-training apparatus for simulating crawl swimming movements, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The figure of the drawing is a side-elevational view of an exemplary embodiment of a training apparatus according to the invention for simulating crawl swimming movements in the dry.

DESCRIPTION OF THE PREFERRED EMBODIMENTS

Referring now in detail to the single figure of the drawing, there is seen a dry training apparatus which includes, as its essential components, a frame 1 with a supporting element 2 that is adjustable in height (arrow A) and is longitudinally angularly adjustable (arrow B) on the frame, as well as an endless revolving traction member 3. The supporting element 2 is provided with padded parts 2*a* of foam or with a water-filled or air-filled envelope. In a position for use, a non-illustrated person being trained rests with his or her stomach on the supporting element 2. The supporting element 2 has a cantilevered part 2*b*, with an end that extends approximately as far as the middle of the traction member 3. The traction member includes an endless belt 4 of hard elastic material, which is guided by first and second deflection rollers 5, 6. The width of the belt is approximately equivalent to that of a human hand.

The deflection rollers 5, 6 are supported on the frame or stand 1 on struts 7, 8 that are adjustable in the longitudinal direction (arrow C). The first deflection roller 5, which is located below the supporting element 2, is adjustable in height (arrow D) in a vertical guide 7*a* in the strut 7, and the second deflection roller 6 is longitudinally adjustable (arrow E) in a horizontal guide 8*a* and thus acts as a tensioning roller.

A braking belt 9 is disposed on the second deflection roller 6 and is connected to the frame 1 through a tension spring 10 and a tensioning element 11. Three handles 12 which are located on the revolving belt 4 protrude from its surface and are spaced uniformly relative to one another.

In order to perform crawl training in the dry, the user rests with his or her stomach on the padded parts 2*a* of the supporting element 2. The height of the position of the supporting element 2, its inclined position, as well as the angular position of the traction member 3, permit an adjustment of the user relative to the belt 4 in such a way that the user can grasp a handle 12 behind the second deflection roller 6 with one hand and can move an upper side, strand or run of the belt 4, because of the elasticity and sagging thereof, along a curved path that also corresponds to the motion of the hand in crawl swimming in the water.

The plane of the supporting element 2 is adjustable relative to the plane of the running belt 4 at an angle of $\alpha=0$ to 30°, and is also adjustable in height, thus enabling an adaptation to the particular bodily form, for instance the arm length, of the user. The length and elasticity of the belt 4 is chosen in such a way that on one hand, adequate sagging of the belt with the active hand acting on a handle is possible. On the other hand, however, the belt is rigid enough to ensure that when force is exerted on a handle 12, the belt is not made to sag or be kinked vertically. Moreover, sagging of the belt 4 can also be regulated because it can be tightened by the second deflection roller 6, through the use of the horizontal guide 8*a* in the strut 8.

On the other hand, the length of the traction member defines the spacing of the handles 12, in such a way that once an arm pull has been executed, the other hand (the guiding hand of the crawl swimmer) is already in the waiting position, and after a brief synchronizing phase, in which the traction member 3 has not yet come to a stop, because of the rotational energy of the deflection rollers 5, 6 and the kinetic energy of the belt 4, or in other words in which an only insignificant drop in belt speed is noted, this hand, which now becomes the active hand, now takes over the task of moving the belt 4 onward.

In this way, sequences of motion in the arms and upper body of the user and force relationships can be established that essentially match or at least come quite close to the motion of a swimmer in the water. The synchronizing phase, in which the guiding hand remains in a waiting position, also dictates a uniform rhythm that corresponds to actual conditions in crawl swimming to the athlete or trainee. The effect is thus also that the crawl technique is learned and practiced. For a predetermined uniformity of arm motions, that is a uniform exchange between the guiding and the active hand, the frequency of motion can nevertheless be influenced by the athlete. Nevertheless, because of the simulation of force conditions of a body moving forward in the water, there is no need to fear an overload on the muscles, ligaments or joints.

The size of the deflection rollers 5, 6 is fixed in such a way that no impeding forces arise between the revolving belt 4 and the deflection rollers 5, 6. Preferably, the roller diameter d is at least 15 cm. On the other hand, the length of the synchronizing phase, that is the waiting phase of the guiding hand or the undriven phase of the belt, is determined by the size of the roller diameter d and a spacing Δ between the handles 12. The ratio between the roller diameter d and the handle spacing Δ is between 1:7 and 1:9. Finally, however, the moment of inertia of the system including the deflection rollers 5, 6 and the revolving belt 4 must not drop below a certain value, so that the traction member 3 will not come to a stop in the synchronizing phase in which it is not driven. However, a speed drop of up to 10% is acceptable.

In the exemplary embodiment, a belt 4 with three equally spaced-apart handles 12 is provided. It is naturally also conceivable for more than three handles to be provided. This increases the length of the traction member 3 but also the amount of space it requires.

On the other hand, it is possible to use an even longer or shorter belt length for persons of substantially shorter or taller stature, along with a belt 4 that has a suitable standard length for the predominant majority of users. Such belts may preferably also be capable of being lengthened, such as by a turnbuckle, VELCRO, other fasteners or another device 4*a* for lengthening the revolving belt.

It has moreover been found that the training effect is readily attained even with a revolving belt of only a slight width, for example 10 cm, so that the space required remains within bounds in this respect as well.

The magnitude of the force to be brought to bear in an arm motion in order to actuate the traction member is adjusted, in accordance with a speed of 1.5 m/s assumed for an imaginary motion in the water, to a corresponding resistance force of 10–15 kp. If the frequency of arm motions in the dry training apparatus is increased, then an increase in swimming speed is simulated, in which the exertion of force at the arms decreases correspondingly, relative to the motion conditions in the water.

I claim:

1. A dry-training apparatus for simulating crawl swimming movements, comprising:

deflection rollers;

a braking device for said deflection rollers;

an endless traction member guided over said deflection rollers, said traction member having an endless belt of hard elastic material with a surface, a lower strand, and an upper strand that can deflect elastically toward said lower strand;

a supporting element disposed above said traction member; and at least three handles firmly joined to said surface of said endless belt for moving said traction member in alternation by two hands of a user located on said supporting element, said handles disposed at a mutual spacing causing a resting and synchronizing phase to necessarily ensue between two exertions of force on successive handles, in which phase said traction member moves onward solely by its moment of inertia, and the force exerted by the hand of the user on said revolving belt causing said revolving belt formed of said elastic material to follow along a curved path that corresponds to a motion of the hand doing a crawl swimming stroke in water.

2. The dry training apparatus according to claim 1, wherein said traction member has a tip, and said supporting element and said traction member have longitudinal axes forming an acute angle $\alpha \leqq 30°$ originating at said tip.

3. The dry training apparatus according to claim 1, including a frame on which said supporting element is angularly adjustable in longitudinal direction and is adjustable in height.

4. The dry training apparatus according to claim 3, including a strut, and a vertical guide on said strut, said first deflection roller associated with said vertical guide for adjusting said traction member in height.

5. The dry training apparatus according to claim 3, including a strut, and a horizontal guide on said strut, said deflection roller associated with said horizontal guide for tightening said endless belt.

6. The dry training apparatus according to claim 4, wherein said strut is adjustable in horizontal direction on said frame.

7. The dry training apparatus according to claim 5, wherein said strut is adjustable in horizontal direction on said frame.

8. The dry training apparatus according to claim 1, wherein said at least three handles are more than three handles, and said revolving belt has a device for lengthening said revolving belt.

9. A dry-training apparatus for simulating crawl swimming movements, comprising:

deflection rollers;

a braking device for said deflection rollers, said braking device having a braking belt wrapped around one of said deflection rollers;

an endless traction member guided over said deflection rollers, said traction member having an endless belt of hard elastic material with a surface, a lower strand, and an upper strand that can deflect elastically toward said lower strand;

a supporting element disposed above said traction member;

a frame on which said supporting element is angularly adjustable in longitudinal direction and adjustable in height;

an adjustable tensioning device securing said braking belt to said frame; and at least three handles firmly joined to said surface of said endless belt for moving said traction member in alternation by two hands of a user located on said supporting element, said handles disposed at a mutual spacing causing a resting and synchronizing phase to necessarily ensue between two exertions of force on successive handles, in which phase said traction member moves onward solely by its moment of inertia.

10. The dry training apparatus according to claim 9, wherein said braking device has a braking force to be adapted as a function of a measured actual speed of said revolving belt.

11. The dry training apparatus according to claim 9, wherein said braking device has a resistance force with a magnitude to be adjusted up to 196.2 N to be overcome by a user.

12. The dry training apparatus according to claim 1, wherein the moment of inertia of said traction member causes a drop in speed in the undriven synchronizing phase of said traction member to be ≦10%.

13. The dry training apparatus according to claim 1, wherein said deflection rollers each have a diameter ≧15 cm.

14. The dry training apparatus according to claim 1, wherein said deflection rollers have a diameter in proportion to the spacing between said handles, and a ratio between the diameter and the spacing is between 1:7 to 1:9.

15. The dry training apparatus according to claim 1, wherein said deflection rollers have a diameter in proportion to the spacing between said handles, and a ratio between the diameter and the spacing is 1:8.

16. A training apparatus for simulating movements made while participating in sports, comprising:

deflection rollers;

a braking device for said deflection rollers;

an endless traction member guided over said deflection rollers, said traction member having an endless belt of hard elastic material with a surface, a lower strand, and an upper strand that can deflect elastically toward said lower strand;

a supporting element disposed above said traction member; and at least three handles firmly joined to said surface of said endless belt for moving said traction member in alternation by two hands of a user located on said supporting element, said handles disposed at a mutual spacing causing a resting and synchronizing phase to necessarily ensue between two exertions of force on successive handles, in which phase said traction member moves onward solely by its moment of inertia, and the force exerted by the hand of the user on said revolving belt causing said revolving belt formed of said elastic material to follow along a curved path that corresponds to a motion of the hand doing a crawl swimming stroke in water.

* * * * *

UNITED STATES PATENT AND TRADEMARK OFFICE

CERTIFICATE OF CORRECTION

PATENT NO : 5,957,815

DATED : September 28, 1999

INVENTOR(S) : Hermann Labrenz

It is certified that error appears in the above-identified patent and that said Letters Patent are hereby corrected as shown below:

On the title page add

Item [30]

May 26, 1994 [DE] Germany ..... P44 18 795.5

Signed and Sealed this

Twenty-fourth Day of October, 2000

*Attest:*

Q. TODD DICKINSON

*Attesting Officer*

*Director of Patents and Trademarks*